US006413157B1

(12) United States Patent
Marton

(10) Patent No.: US 6,413,157 B1
(45) Date of Patent: Jul. 2, 2002

(54) DOUBLE ACTION ORBITAL SANDER

(76) Inventor: Miksa Marton, 2495 Santo, Windsor, Ontario (CA), N9G 2J7

( * ) Notice: Subject to any disclaimer, the term of this patent is extended or adjusted under 35 U.S.C. 154(b) by 0 days.

(21) Appl. No.: 09/738,305

(22) Filed: Dec. 15, 2000

(51) Int. Cl.[7] ..... B24B 23/00

(52) U.S. Cl. ..... 451/357; 451/356; 451/344; 451/359

(58) Field of Search ..... 451/344, 356, 451/357, 359

(56) References Cited

U.S. PATENT DOCUMENTS 5,123,216 A * 6/1992 Kloss et al. ..... 451/357

6,257,970 B1 * 7/2001 Huber ..... 451/357

* cited by examiner

*Primary Examiner*—Joseph J. Hail, III
*Assistant Examiner*—Shantese McDonald
(74) *Attorney, Agent, or Firm*—Fildes & Outland, P.C.

(57) ABSTRACT

A rotary orbital sander includes internal suction channels connecting with a suction housing connectable with a vacuum source for removing sanding waste during sanding. A dual weight balancing arrangement includes oppositely extending weights in planes spaced above a sanding pad to completely balance the eccentric rotary pad with the separately located weights.

16 Claims, 5 Drawing Sheets

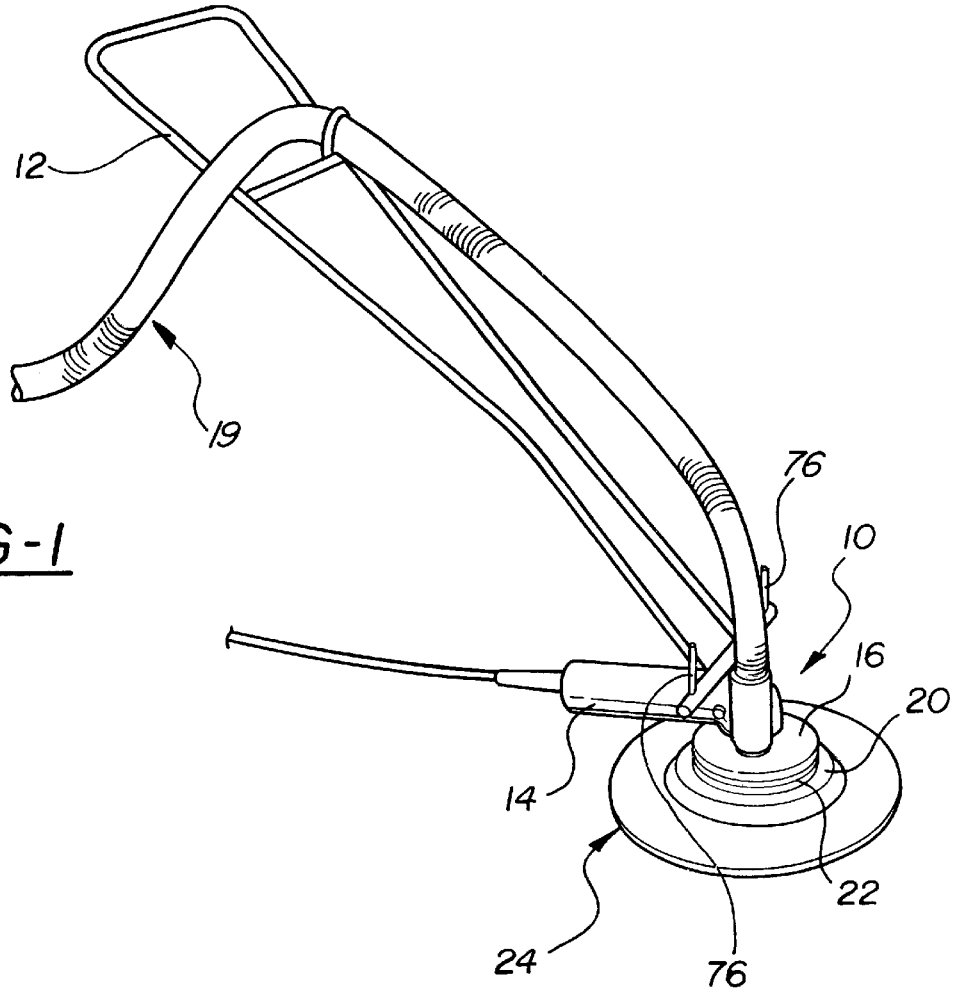
FIG-1
FIG-3
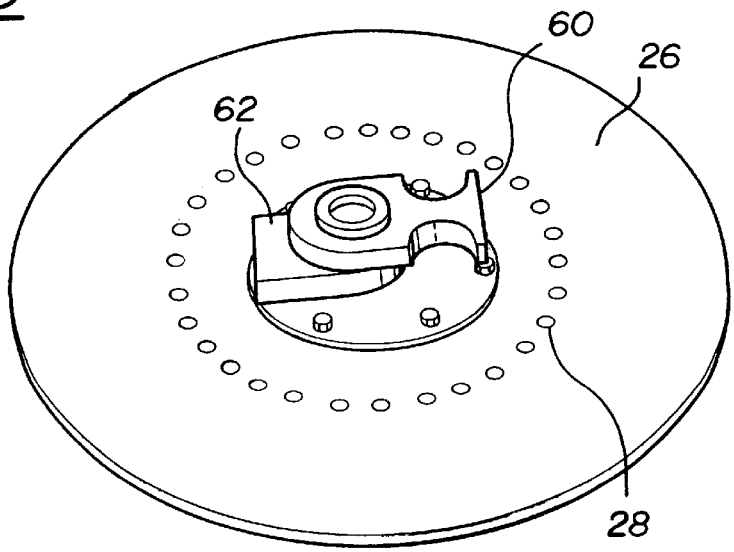

10
14
16
17
18
20
22
24
26
28
30
32
34
36
38
44
50
52
54
56
58
60
62
64
66
68
70
72

FIG-6
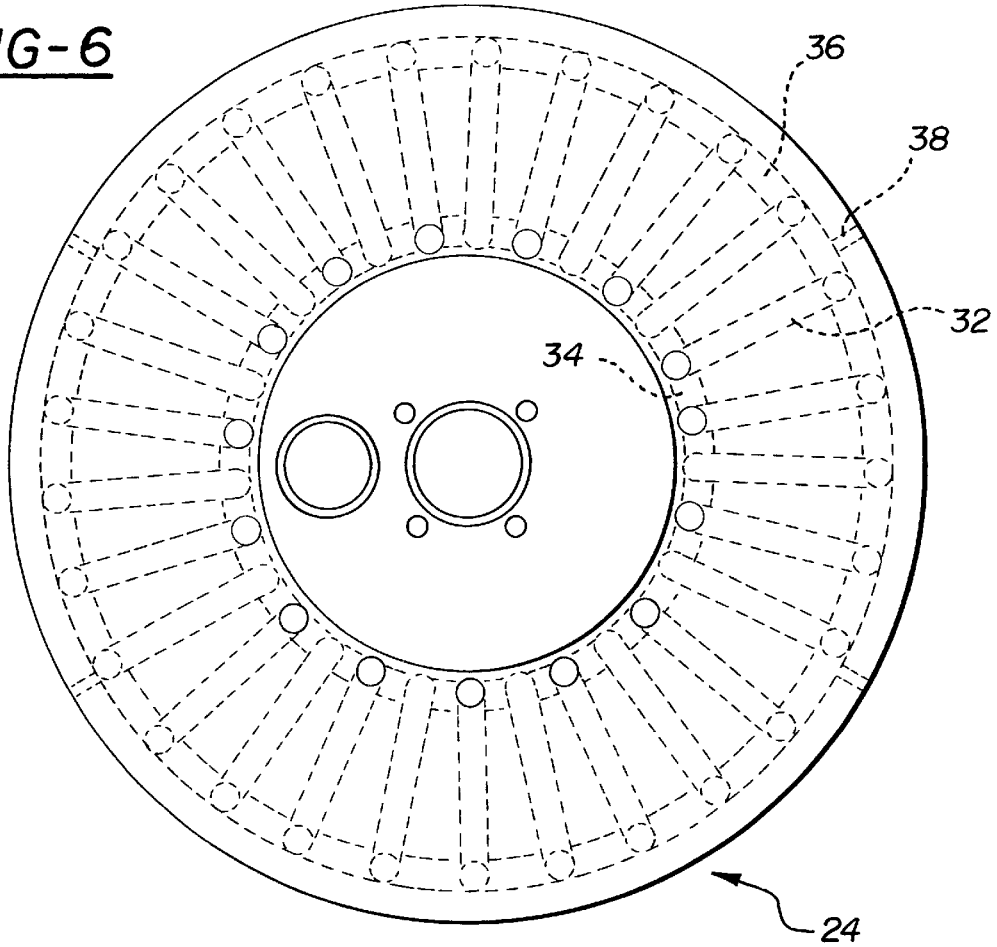
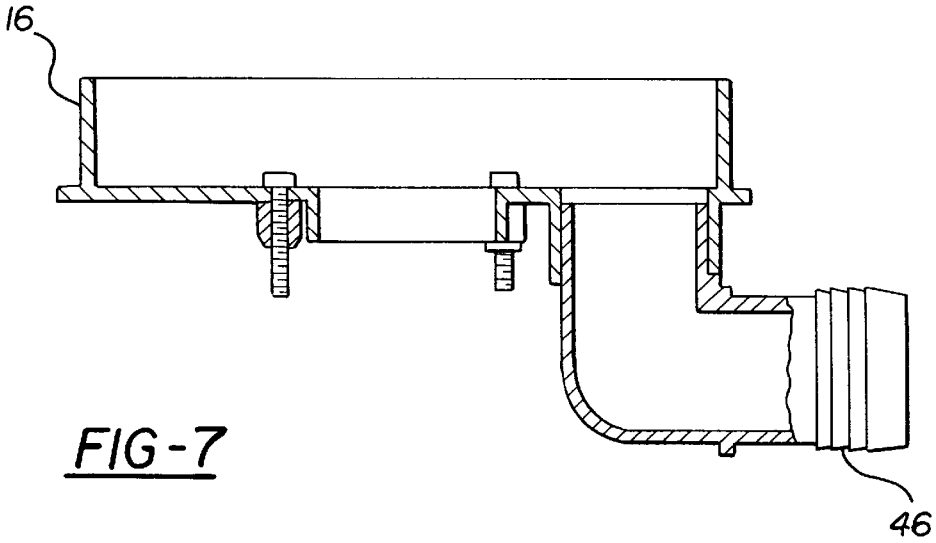
FIG-7

DOUBLE ACTION ORBITAL SANDER

FIELD OF THE INVENTION

This invention relates to a rotary orbital sander, and more particularly to a rotary orbital sander that is adapted for use with a vacuum source.

BACKGROUND OF THE INVENTION

It is known in the art relating to rotary orbital sanders to combine a sander and a vacuum to pick up particles of sanding waste that are loosened during the sanding process. Such prior art sanders, however, lack sufficient suction to draw particles from a significant distance from the vacuum (e.g. at the outer edge of the sander). Moreover, the vacuum simply blows internal particles rather than drawing them away from the sanding means and floor.

It is also known to balance orbital sanders using a counterbalance weight located in the plane of the unbalanced sanding rotor. However, placement of the balance weight requires a special design of sanding pad assembly.

SUMMARY OF THE INVENTION

The present invention provides a rotary orbital sander that solves the disadvantages of the prior art sanders by providing a suction housing that connects with a vacuum source such as a conventional shop vacuum. The suction housing is adjustably sealed to a unique sanding pad assembly having a plurality of radially extending suction channels connected with inner and outer annular channels. The suction channels draw air and sanding waste into the channels through holes in a sanding pad aligned with the annular channels so that loosened particles under the sanding disk are readily drawn through the channels into the suction housing and out a vacuum hose. The sanding pad assembly may also include side suction channels at the peripheral edge of the sanding pad to draw in sanding waste from beyond the sanding pad periphery.

Alternatively, the radial channels may be omitted and inner and/or outer annular channels can be fed through openings in a sanding disk. Sanding waste is carried from the annular channels through openings on the sanding pad directly to the suction housing which is enlarged to cover the outermost channel diameter.

The invention also provides a balancing assembly using a pair of balance weights oriented oppositely and spaced from the sanding pad to completely balance eccentric forces without requiring a complicated sanding pad assembly. This arrangement permits the sanding pad to be very large in diameter, greater than 8 inches. In fact, a 16 inch sanding pad has been successfully used in accordance with the invention. Moreover, the throw out, or radius of eccentricity that creates the orbital motion, of the present invention, exceeds 4 mm.

The rotary orbital sander of the present invention is adapted for use with pneumatic or electric tools. It is further suitable for coarse or the finest sanding.

These and other features and advantages of the invention will be more fully understood from the following detailed description of the invention taken together with the accompanying drawings.

BRIEF DESCRIPTION OF THE DRAWINGS

In the drawings:

FIG. 1 is a perspective view of an electric rotary orbital sander according to the present invention;

FIG. 3 is a perspective view of a drive head assembly coupled to a sanding pad assembly of the rotary orbital sander of FIG. 1;

FIG. 6 is a plan view of the suction housing and sanding pad assembly of the sander of FIG. 1;

FIG. 7 is a cross-sectional view of the suction housing from the line B–C of FIG. 6;

DETAILED DESCRIPTION OF THE INVENTION

Figures 2, 4, 5:
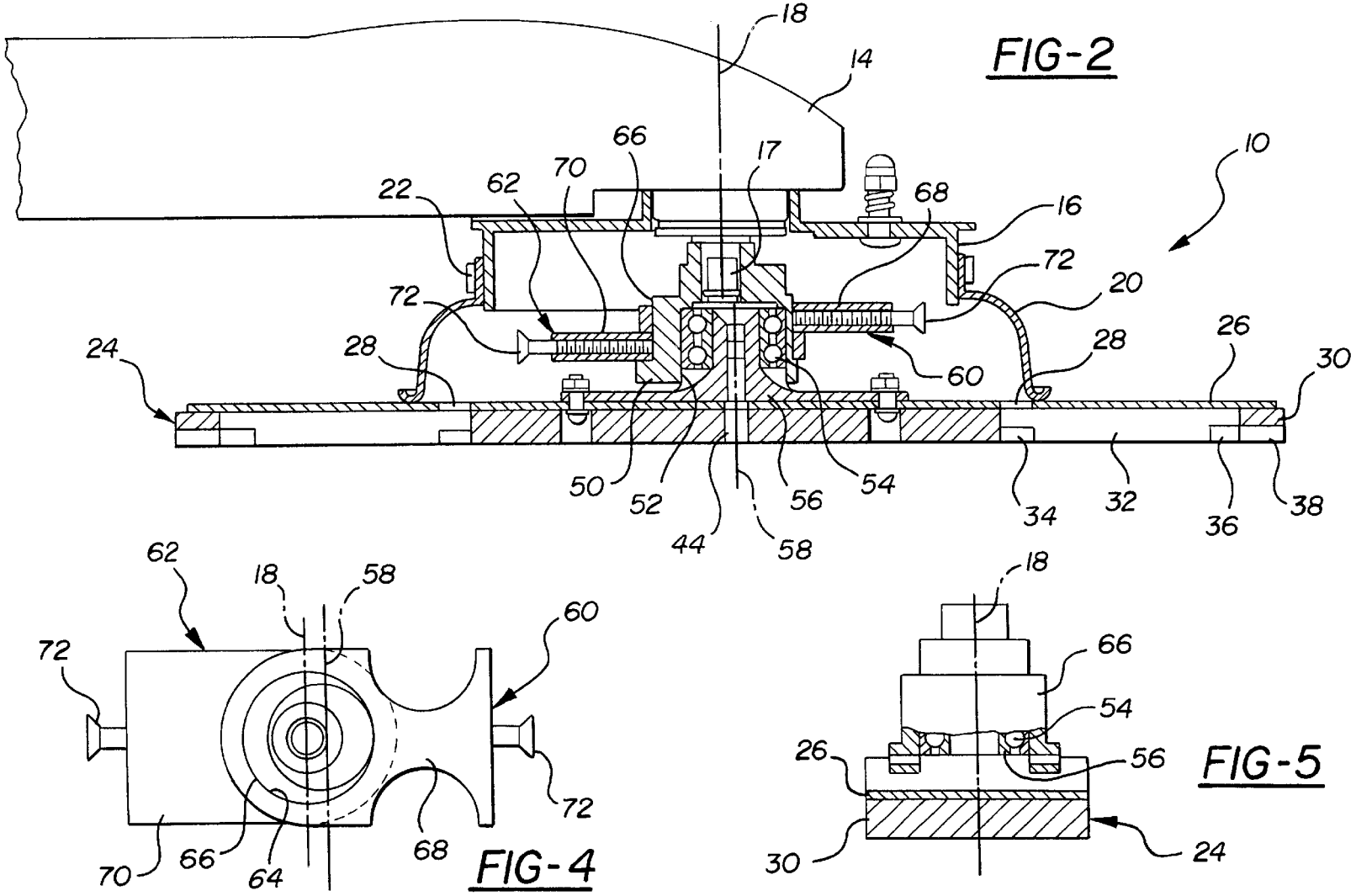
FIG. 2 is a cross-sectional view of the rotary orbital sander of FIG. 1.
FIG. 4 is an enlarged plan view of the drive head assembly of FIG. 3.
FIG. 5 is a side view of a drive head in the rotary orbital sander of FIG. 1.

Referring now to the drawings in detail, numeral 10 generally indicates a first embodiment of a rotary orbital sander according to the present invention. Sander 10, as shown in FIG. 1, includes an elongated handle 12 mounted to a drive motor 14. The motor 14 is mounted to the upper surface of a suction housing 16 which receives a motor shaft 17 having an axis 18 as shown in FIG. 2. The suction housing 16 is further adapted to connect with a vacuum source, for example, a hose 19 connectable to a conventional shop vacuum (not shown).

As shown in FIG. 2, the suction housing 16 includes an adjustable suction ring 20 that is clamped to the housing with a hose clamp 22. Raising or lowering the suction ring 20, decreases or increases the vacuum suction accordingly. The suction ring 20 lightly contacts or is spaced closely to a sanding pad assembly (shown generally as reference numeral 24) without interfering with the rotation of the sanding pad assembly 24.

As best shown in FIG. 3, the sanding pad assembly 24 includes a pad backing 26 having a plurality of holes 28 formed therein and annularly spaced about a center axis 29 of the sanding pad assembly 24. The suction housing 16 encloses the holes 28 which provide an outlet for loosened particles or sanding waste to be removed by the vacuum source. In a preferred embodiment, the pad backing 26 is made of a lightweight metal such as aluminum or strong, light, powerful plastic type material.

Figure 9:
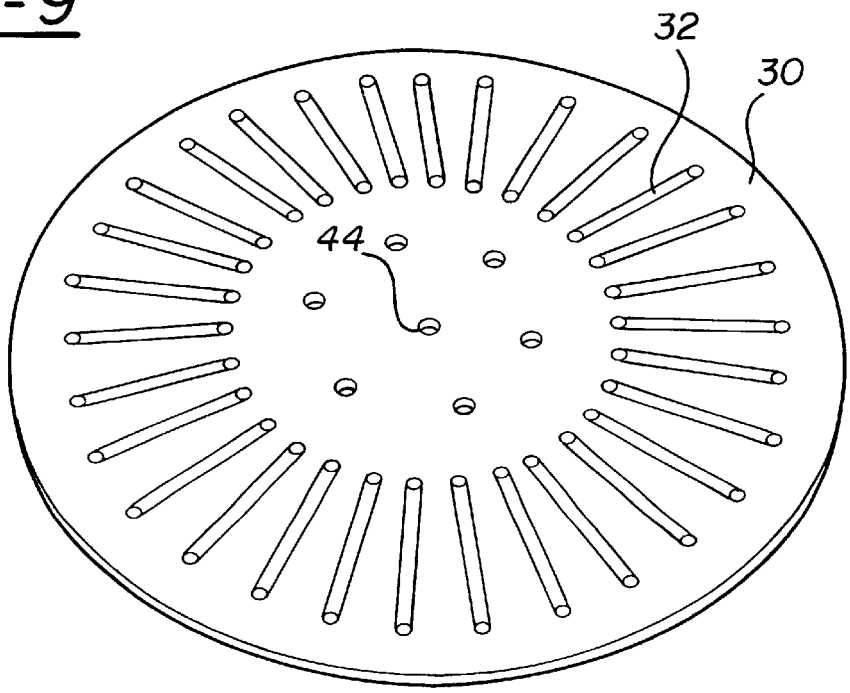
FIG. 9 is a lower perspective view of the sanding pad of the sander of FIG. 1.

The pad backing 26 is mounted to a circular rubber sanding pad 30 as shown in FIG. 9. As best illustrated in FIG. 6, sanding pad 30 includes a plurality of radially extending suction channels 32 connecting at their inner ends with an inner annular channel 34 open to the holes 28 of the pad backing 26. At their outer ends, radial channels 32 connect with an outer annular channel 36 located near the periphery of the sanding pad 30.

The sanding pad 30 may also include side channels 38 at the peripheral edge of the sanding pad 30, connecting with outer annular channel 36. Channels 32 and 36 draw air from the periphery of the sanding pad 30 and direct the air to channel 34 which also draws air from an inner portion of the pad 30. When particles are loosened during the sanding process, they are drawn by the vacuum source into channels 36, 32 and/or 34, up through holes 28 of the pad backing and out vacuum hose 19. Side channels 38 provide additional paths for drawing air through the peripheral edge of the sanding pad 30 to the outer annular channel 36.

Alternatively, a single annular channel may be provided which connects with a set of holes in the sanding disk, the annular channel also connects with holes in the pad backing, thereby eliminating the radial channels and the additional annular channel. In such an embodiment, the suction housing would be appropriately sized to enclose the holes of the pad backing which are aligned with the holes of the sanding pad. A second concentric annular channel and aligned rings of holes in the sanding pad and pad backing may also be provided, if desired.

Figure 8:
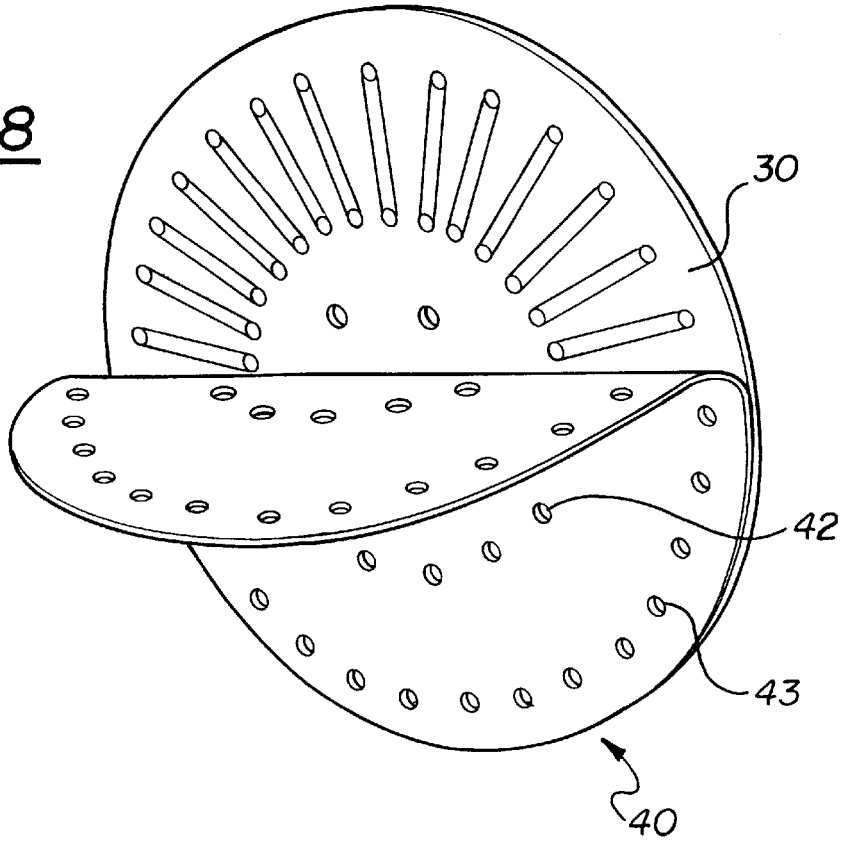
FIG. 8 is a partial lower perspective view of the sanding pad and pad assembly of the sander of FIG. 1.

As shown in FIG. 8, the sanding pad 30 is adapted to receive a piece of complimentary sized and shaped sand paper, such as a circular (or other suitably shaped) sanding disk 40, having a plurality of annularly spaced holes 42 that are aligned in assembly with the inner channel 34 of the sanding pad 30 which in turn connects with the holes 28 of the pad backing 26. Additional annularly spaced holes 43 are aligned with the outer annular channel 36, which connects through radial channels 32 with the inner channel 34. By providing at least one annular channel about the sanding pad which connects with holes in the pad which align with holes in the pad backing, it is not necessary for the user to precisely align the holes of the sand paper with holes in the pad backing. Suction from the vacuum will draw particles through the channel to the closet hole for elimination from the suction housing. To achieve this objective, the pad includes a central hole 44 which, when aligned with a central hole (not shown) in the sanding disk 40, causes each of the holes of the sanding disk to become sufficiently aligned with the annular channels 34, 36 of the pad.

In operation, a vacuum source, such as a conventional shop vacuum, is connected to the suction housing 16. In a preferred embodiment, the vacuum hose 19 is connected to a fitting 46, attached to the suction housing 16, shown in cross section in FIG. 7 along the line B–C of FIG. 6. Fitting 46 connects the vacuum suction directly to the sanding pad assembly 24.

The sander is contained within the suction housing 16 and operates in orbital fashion by means of an eccentric rotary drive head 50 rotatably driven about the axis 18 by the motor shaft 17 as shown in FIG. 2. The drive head 50 includes an eccentric recess portion 52 off-set from the center line of the shaft 17. Disposed in the recess 52 is a double ball bearing assembly 54 which supports a carrier 56 within the off-set portion 52 of the motor shaft 17. The carrier 56 is mounted to the pad backing 26 and forms a part of the previously described sanding pad assembly 24.

As shown in FIG. 2, the sanding pad assembly 24 is supported by the bearing assembly 54 for free rotation about an axis 58 that is radially offset from the motor shaft axis 18. The sanding pad assembly 24 is, thus, driven by the motor 14 and drive head 50 in an orbital pattern around the motor shaft axis 18. Assembly 24 is also free to rotate about the central axis 58 of the sanding pad assembly 24 and its carrier 56.

In order to balance the eccentric mass of the sanding pad assembly 24 in its orbital rotation about the axis 18, a combination of a first balance weight 60 and a counterbalance weight 62 are mounted on the drive head 50 above the center of gravity of rotation of the pad assembly 24. The first balance weight is located uppermost on the drive head 50 and has a center of gravity of rotation offset from the axis 18 in the same direction as the rotational gravity center of the pad assembly 24. The purpose of this first balance weight 60 is to raise the center of gravity of rotation of the drive head assembly, including the pad assembly 24, to a level above the pad assembly 24. The total rotational unbalance of the drive head assembly is then offset by locating the counterbalance weight with its center of gravity of rotation radially opposite to that of the total drive head assembly and providing an equal rotational mass.

The drive head assembly with its sanding pad assembly 24 and the two oppositely directed balance weights 60, 62 is thus perfectly balanced with both the eccentric masses and the bending couples applied to the motor shaft by the eccentric masses being completely offset. Accordingly, the first balance weight 60 is lighter than the counterbalance weight 62 and is located higher on the drive head 50 than the counterbalance weight 62, thereby eliminating the tendency of the sanding pad to flap during rotation. The orbital sander thus runs smoothly without vibration and can be easily guided by the operator in a motion similar to floating over the surface being sanded.

Figure 10:
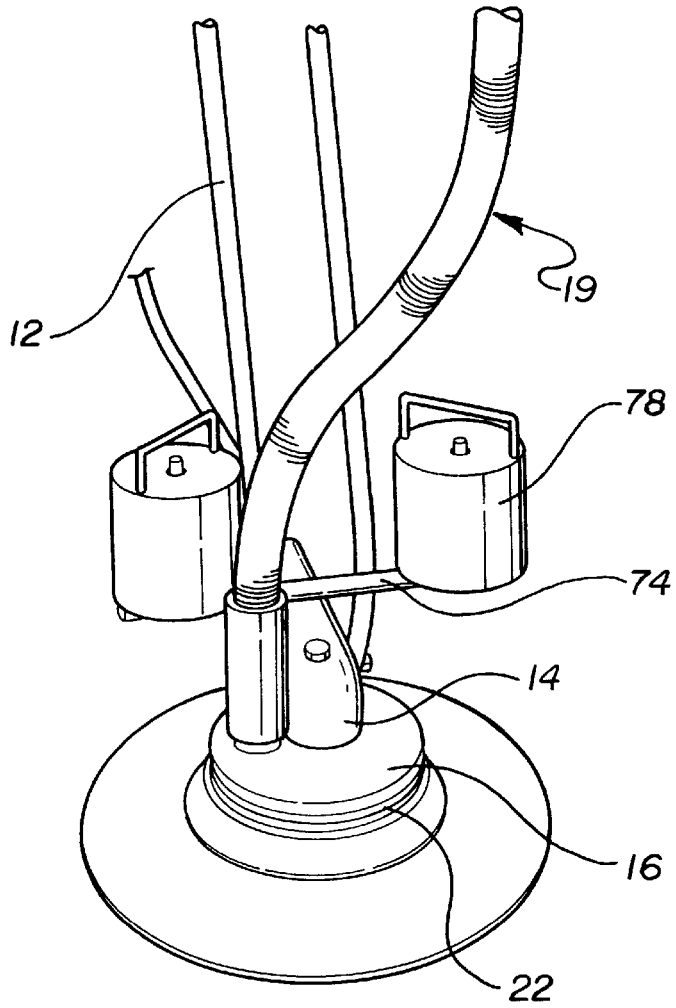
FIG. 10 is a perspective view of a second embodiment of a rotary orbital sander according to the present invention.

The drive head and balance weights may be made in any desired manner and could be combined in an integral body. However, in the present embodiments, the first balance weight 60 and the counter balance weight 62 are both made with circular bores 64 fitted over a cylindrical portion 66 of the drive head 50. The weights both have laterally extending arms 68, 70 that provide their eccentric masses, the rotational mass of the arm 68 of the first balance weight 60 being substantially less than that of the arm 70 of the counterbalance weight 62. Both weights 60, 62 are retained on the drive head by locking screws 72, which extend through their respective arms to engage the cylindrical portion 66 of the drive head 50. Alternatively, weights 60, 62 may be permanently attached to the drive head 50.

Where the surface to be sanded is particularly rough, weights may be added to the rotary orbital sander of the present invention. As shown in FIG. 10, elongated handle 12 is provided with a cross bar 74 having a center along the center line of the motor shaft 17. As shown in FIG. 1, at each end of the cross bar 60 is an upstanding pin 76. A third pin may be located at the center of the cross bar. Each pin 76 removably receives an appropriate weight 78. When two weights are used, weights 64 of equal mass are equidistantly disposed on the pins 76 located on either side of the center line of the motor shaft 17. A third weight may be added to the centrally located pin.

Figure 11:
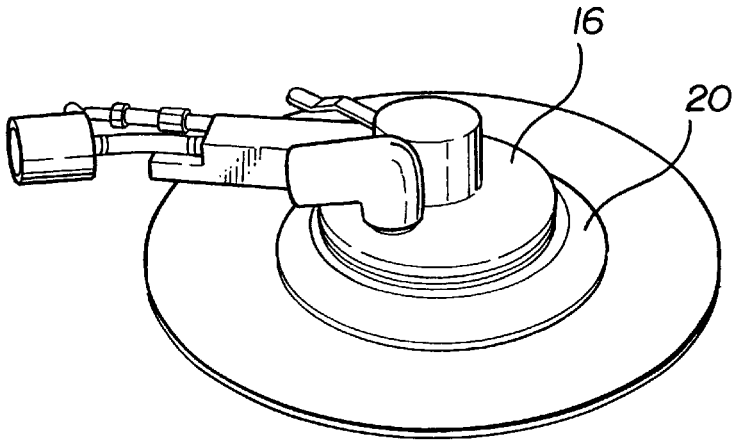
FIG. 11 is a plan view of a third embodiment showing a pneumatic rotary orbital sander according to the present invention.

Of course, any suitable motor may be used to rotate the motor shaft 17. By way of example, a first preferred embodiment of FIGS. 1, 2, 10 uses an electric motor. The motor shaft may also be pneumatically driven as illustrated in FIG. 11.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A rotary orbital sander, comprising:

a motor having a rotatable shaft with a radially off-set portion;

a suction housing mounted to the motor, enclosing said motor shaft and connectable with a vacuum source, a counterbalance weight disposed on said shaft within said suction housing;

a sanding pad assembly mounted to the radially off-set portion of said shaft, and sealable with said suction housing;

said sanding pad assembly further including a pad having a plurality of radially extending suction channels, each connecting with inner and outer annular channels, said inner channel connecting with the interior of said suction housing.

2. The rotary orbital sander of claim 1, wherein said sanding pad assembly further includes a sanding disk having a size and shape complimentary to said sanding pad, and a plurality of holes for alignment with at least one of the annular suction channels.

3. The rotary orbital sander of claim 1, wherein said counterbalance weight assembly includes a radially elongated weight disposed about the motor shaft.

4. The rotary orbital sander of claim 1, wherein said sanding pad further includes at least one side suction channel located at the periphery of said pad and connected with the outer annular channel.

5. The rotary orbital sander of claim 1, further comprising a handle mounted to the motor.

6. The rotary orbital sander of claim 5, wherein said handle includes means for removably receiving at least one weight balanced about the center line of said motor shaft.

7. The rotary orbital sander of claim 1, wherein said sanding pad assembly has a diameter of at least 16 inches.

8. The rotary orbital sander of claim 1, wherein said sanding pad assembly has a diameter of at least 8 inches.

9. A sanding pad assembly for use with a rotary orbital sander having a suction housing connectable with a vacuum source for drawing out sanding waste, said sanding pad assembly comprising:

a sanding pad having a periphery;

a plurality of suction channels radially extending between inner and outer annular channels, the inner annular channel being connectable with a vacuum source.

10. The sanding pad assembly of claim 9, further comprising at least one side suction channel located at the periphery of said pad and connecting with the outer annular channel.

11. The sanding pad assembly of claim 9, wherein said plurality of suction channels are angularly spaced 360° around the center of the sanding pad assembly and said pad further includes a locating hole at its center for aligning a sanding disk with the pad.

12. The sanding pad assembly of claim 9, further including a sanding disk having a plurality of holes disposed in inner and outer rings about the center of the sanding disk, and a hole at the center of said sanding disk alignable with the center hole of said sanding disk so that the plurality of holes of the pad align with the annular channels in the sanding pad assembly.

13. A sanding pad assembly comprising:

a pad backing having a drive connection on a first side and a sanding disk mounting surface on an opposite second side extending to an outer edge of the pad backing;

the second side including an outer annular channel spaced inwardly adjacent the outer edge, an inner annular channel spaced inward of the outer annular channel, and a plurality of intermediate channels interconnecting the annular channels; and annularly spaced vacuum openings through the backing disk between one of the annular channels and the first side;

the annular channels being positioned to receive sanding waste through radially aligned rings of annularly spaced openings in an associated sanding disk mountable on the mounting surface and to direct the sanding waste through the annular and intermediate channels to the vacuum openings for disposal in a connected vacuum source.

14. A rotary orbital sander, comprising:

a rotary drive head connectable with a drive motor for rotation on an axis;

a sanding pad assembly eccentrically mounted on the drive head and including a pad backing spaced axially adjacent the drive head and adapted to mount to a sanding disk, the pad assembly having a center of gravity of rotation eccentric to the axis;

a first balance weight eccentrically mounted on the drive head and having a center of gravity of rotation spaced axially from and generally radially aligned with that of the sander pad assembly; and a counterbalance weight eccentrically mounted on the drive head and having a center of gravity of rotation spaced axially between and oriented radially opposite to those of the first balance weight and the sander pad assembly, the mass and eccentricity of the counter balance weight and its axial position being selected to balance both the centrifugal force and the unbalanced couples of the eccentric masses of balance weight and the sander pad assembly.

15. A rotary orbital sander as in claim 14, wherein the sanding pad assembly comprises:

a pad backing having a drive connection on a first side and a sanding disk mounting surface on an opposite second side extending to an outer edge of the backing;

the second side including an outer annular channel spaced inwardly adjacent the outer edge, an inner annular channel spaced inward of the outer annular channel, and a plurality of intermediate channels interconnecting the annular channels; and annularly spaced vacuum openings through the pad backing between one of the annular channels and the first side;

the annular channels being positioned to receive sanding waste through radially aligned rings of annularly spaced openings in an associated sanding disk mountable on the mounting surface and to direct the vacuumed waste through the annular and intermediate channels to the vacuum openings for disposal in a connected vacuum source.

16. A sanding pad assembly for use with a rotary orbital sander having a suction housing connectable with a vacuum source for drawing out sanding waste, said sanding pad assembly comprising at least one annular channel connectable with a vacuum source.

* * * * *